US011059007B2

(12) United States Patent
Dobos et al.

(10) Patent No.: US 11,059,007 B2
(45) Date of Patent: Jul. 13, 2021

(54) ROTOR OF A DUAL CENTRIFUGE

(71) Applicant: ANDREAS HETTICH GMBH & CO. KG, Tuttlingen (DE)

(72) Inventors: Jovan Dobos, Tuttlingen (DE); Anke Lenz, Leibertingen (DE); Ulrich Massing, Merzhausen (DE); Klaus-Guenter Eberle, Tuttlingen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 455 days.

(21) Appl. No.: 15/539,131

(22) PCT Filed: Nov. 24, 2015

(86) PCT No.: PCT/EP2015/077534
§ 371 (c)(1),
(2) Date: Jun. 22, 2017

(87) PCT Pub. No.: WO2016/107704
PCT Pub. Date: Jul. 7, 2016

(65) Prior Publication Data

US 2017/0348653 A1 Dec. 7, 2017

(30) Foreign Application Priority Data

Jan. 2, 2015 (DE) ..... 102015100006.7

(51) Int. Cl.
*B01F 9/00* (2006.01)
*B04B 5/02* (2006.01)
*B04B 9/12* (2006.01)

(52) U.S. Cl.
CPC ..... *B01F 9/0001* (2013.01); *B04B 5/02* (2013.01); *B04B 9/12* (2013.01)

(58) Field of Classification Search
CPC ..... B01F 9/0001; B04B 9/12; B04B 5/02
(Continued)

(56) References Cited

U.S. PATENT DOCUMENTS 4,082,217 A 4/1978 Westberg
4,820,257 A * 4/1989 Ishimaru ..... B04B 5/0414 494/16

(Continued)

FOREIGN PATENT DOCUMENTS

CN 1872378 12/2006
CN 102481493 5/2012

(Continued)

OTHER PUBLICATIONS

JP 2013188657 Description Espacenet Machine Translation.*

(Continued)

*Primary Examiner* — Walter D. Griffin
*Assistant Examiner* — Shuyi S. Liu
(74) *Attorney, Agent, or Firm* — Woodling, Krost and Rust

(57) ABSTRACT

The invention relates to a rotor (10) of a dual centrifuge wherein the rotor has a rotor head (12) and an additional rotational mechanism for at least one rotational unit (22) which is provided in the rotor head (12) and comprises a bearing unit (70) and a rotational head (24) that is connected to the bearing unit (70) which is rotatably mounted and can be driven relative to the rotor head (12) by an additional rotational mechanism, an opening (16) for the rotational unit (22) being provided in which the rotational unit is accommodated and by means of which the bearing (70) is arranged such that it is fixed relative to the rotor head (12). The invention is characterized in that the rotational unit (22) has a housing (26) in which the bearing unit (70) is accommodated and in which the rotational head (24) engages, and in that the housing (26) and the rotational head (24) form, with bearing unit (70), a structural unit, the housing (26) being mounted such that it cannot rotate relative to the rotor head (12) and such that it can be detached from the rotor head.

16 Claims, 4 Drawing Sheets

(58) Field of Classification Search
USPC ..... 366/218; 494/31, 33
See application file for complete search history.

(56) References Cited

U.S. PATENT DOCUMENTS

| | | | | |
|---|---|---|---|---|
| 8,092,075 | B2 | 1/2012 | Ishii | |
| 10,688,503 | B2 * | 6/2020 | Henne | B01L 3/5021 |
| 2009/0301107 | A1 * | 12/2009 | Kammer | A61F 7/0085 62/68 |
| 2013/0005559 | A1 * | 1/2013 | Burford | B04B 9/12 494/41 |

FOREIGN PATENT DOCUMENTS

| | | |
|---|---|---|
| CN | 102958576 | 3/2013 |
| DE | 102006047480 | 10/2007 |
| DE | 112004001671 | 10/2012 |
| DE | 102012105819 | 4/2014 |
| JP | 2007190464 | 8/2007 |
| JP | 2009-119587 | 6/2009 |
| JP | 2010240579 | 10/2010 |
| JP | 2010274171 | 12/2010 |
| JP | 201150814 | 3/2011 |
| JP | 2013188657 | 9/2013 |
| KP | 1020050033386 | 4/2005 |
| WO | 2005025717 | 3/2005 |
| WO | 2013183554 | 12/2013 |
| WO | WO-2013183554 A1 * | 12/2013 |

OTHER PUBLICATIONS

JP 2007190464 Description Espacenet Machine Translation.*
DE 102012105819 Description Espacenet Machine Translation.*
The State Intellectual Property Office of China, First Office Action, dated Dec. 20, 2018, pp. 1-12, Application No. 201580071699.3, Applicant: Andreas Hettich GMBH & Co. KG.
Office Action, Japan Patent Office, Notification of Reason for Refusal, English Translation, Patent Application No. 2017-534780, dated Jun. 18, 2019, pp. 1-6.
Office Action, Japan Patent Office, Notification of Reason for Refusal, English Translation, Patent Application No. 2017-534780, dated Jun. 18, 2019, pp. 1-7.
European Patent Office, International Search Report, dated Mar. 3, 2016, pp. 1-11, Applicant: Andreas Hettich GMBH & Co. KG, International Application No. PCT/EP2015/077534.

* cited by examiner

ROTOR OF A DUAL CENTRIFUGE

This patent application is the national phase entry of PCT/EP2015/077534, international application filing date Nov. 24, 2015, which claims the benefit and priority of and to German patent application no. 10 2015 100 006. 7, filed Jan. 2, 2015.

PCT/EP2015/077534, international application filing date Nov. 24, 2015 and German patent application no. 10 2015 100 006.7, filed Jan. 2, 2015 are incorporated herein by reference hereto in their entireties.

The invention relates to a rotor of a dual centrifuge.

Dual centrifuges have already been known for several years. While in a conventional centrifuge samples are rotated about a single axis, in a dual centrifuge samples are rotated about a main axis and at the same time about a secondary axis. Due to the resulting high centripetal force and the centrifugal forces acting in different planes, a higher efficiency is achieved during centrifugation, especially during mixing, when separating or during homogenization of the samples.

DE 10 2012 105 819 A1 discloses a device for the homogenization and separation of samples which comprises a centrifuge having a rotor body. Rotational units are mounted in blind-hole type recesses in the rotor body and arranged so that they can be rotated about a secondary axis of rotation which differs from the axis of rotation of the motor (main axis of rotation). A separate drive is provided for the rotational units so that the rotary movement of the rotational units is generated independent of the drive of the rotor body.

The above invention is an improvement over the prior art in particular in that lubricant escaping from a bearing of a rotational unit remains in the recess associated with the rotational unit where it continues to be available in the area of the bearing. Significantly longer operating times can therefore be achieved than with prior art solutions.

However, practice has shown that during long-term operation, problems due to insufficient cooling will arise in devices according to this invention since the heat created during rotation of the rotational unit accumulates in the recess and cannot be dissipated. Furthermore, there is room for improvement regarding maintenance, repair and cleaning of the device. Especially parts of the bearing that are integrated in the rotor body, such as a bearing outer ring, are difficult to access due to the very small dimensions of the recesses.

It is the object of the invention to avoid the above mentioned shortcomings and to provide a rotor for a dual centrifuge which can be serviced more easily and thus reduces downtime. In particular, the rotational units and recesses associated with the rotational units should be easily accessible for the purpose of maintenance, repair and cleaning, and sufficient cooling for long-term operation should be provided.

The invention is based on the finding that decoupling the bearing of the rotational unit from the rotor body creates better conditions for maintenance, repair and cleaning, as well as for cooling the rotational unit. In addition, this opens up additional design options for optimizing maintenance and cooling.

According to the invention, the rotor of a centrifuge has a rotor head and an additional rotation mechanism for at least one rotational unit disposed in the rotor head. The rotational unit includes a bearing and a rotational head connected to the bearing and rotatably mounted therein, which can be driven relative to the rotor head by means of another rotation mechanism. Here, a recess for the rotational unit and/or for each rotational unit is provided in which it is introduced, thus securely mounting the bearing relative to the rotor head. According to the invention, the rotational unit has a housing which accommodates the bearing and which is engaged by the rotational head, and the housing and the rotational head with the bearing form a structural unit, with the housing being mounted in the rotor head such that it cannot rotate relative to the rotor head and such that it can be detached from the rotor head. This clearly facilitates operation and prolongs the service life of the centrifuge because detachably mounting the housing in the rotor head considerably facilitates cleaning, maintenance and repair of the bearing of the rotational unit. The rotational unit can be removed easily from the rotor head and maintained independently of the rotor head. In addition, the rotational unit can be easily replaced which reduces maintenance-related downtime to a minimum.

According to one aspect of the invention, the recesses extend through a portion of the rotor head. When mounted, the rotational unit passes through the recess, and a lower portion of the housing of the rotational unit protrudes from the recess and is thus exposed to the environment. This arrangement avoids heat accumulation in the recess and the exposed portion is cooled by air flowing past during rotation.

Moreover, owing to the presence of the recess, the length of the rotational unit is not restricted by the dimensions of the rotor body. With the dimensions of the rotor body unchanged, this allows the use of longer rotational units which may, for example, accommodate larger bearings for larger sample vessels. This saves space as well as costs.

In a further advantageous embodiment, the rotor head has a rotationally symmetrical basic shape with an outer surface, with the lower region of the housing protruding beyond this outer surface. This configuration improves the cooling effect, since the protruding portion of the housing provides a good contact surface for the air flowing past.

It has proven particularly efficient to have at least 30%, preferably at least 50%, of the height of the housing protrude from and above the outer surface, since this will yield an optimum ratio of the cooling effect of the air flowing past and the mechanical stress/safety.

Cooling can be further improved by providing cooling ribs in the lower region of the housing so as to enlarge the cooling surface of the rotational unit.

The cooling ribs can be aligned and bent in the direction of rotation of the rotor head, and have a radius starting from the rotational axis of the rotor head that is sufficient to achieve an approximately laminar air flow and to largely prevent no-flow zones and thus non-uniform cooling of the housing. However, various experiments have shown that a turbulent air flow will yield even more efficient cooling. Therefore, it is advantageous if the cooling ribs are positioned at an angle relative to the direction of rotation.

According to a further aspect of the invention, the rotational unit is firmly connected to the rotor head by means of a releasable quick fastener or screw connection. This facilitates mounting and maintenance of the rotational unit.

In a preferred embodiment, on the side of the housing remote from the cooling ribs, a flange is provided which abuts against the rotor head. This flange acts to secure the housing in its associated recess in the direction of the longitudinal axis of the housing.

In one advantageous embodiment of the invention, the recess and the housing of the rotational unit are matched to each other. This allows the housing to be secured in other directions as well, besides the direction of its longitudinal axis, which increases the safety of the centrifuge and prolongs the service life of the rotational units.

This securing can be further improved by anti-rotation means formed by the cross-sectional shape of the housing and the cross-sectional shape of the recess, in particular a polygonal shape or a cylindrical shape with projections and associated grooves. In addition to securely mounting the housing relative to the rotor head as described above, this also avoids undesired rotation of the housing about its own axis.

According to another aspect of the invention, the housing and a housing closure with a central bore for an axis of rotation of the rotational head delimit a bearing space with bearings of the rotational axis. Such a closed bearing space has the advantage that in the event of glass breakage of sample containers, possible contaminants can be contained better.

Preferably, the bearing space is encapsulated towards the outside in a lubricant-tight manner. Consequently, any lubricant escaping from a bearing will be contained within said housing for the entire centrifugation period and will thus be available in the area of the bearing. This significantly reduces the risk of the bearing seizing up. Furthermore, this prevents contamination of the rotor head with lubricant.

It is advantageous if the bearing space is filled with lubricant, especially grease, preferably roller bearing grease SKF LGBB2/0.4. As a result, the bearing will be lubricated during the entire operating time, thereby virtually eliminating bearing seizure.

In a preferred embodiment of the invention, the bearing space is filled with lubricant to up to 50% of the height of the bearing space. This prevents excess lubrication of the bearing.

To be able to check bearing lubrication at any time and to replenish lubricant, if necessary, a lubricant level indicator and/or a lubricant refill valve may be provided.

In an advantageous further development of the invention, an as large as possible part of the surface of the rotational unit is in contact with the rotor head. This ensures optimal heat dissipation from the rotational unit into the rotor head.

The invention also relates to a rotational unit for a rotor having the above mentioned features.

Additional advantages, features and possible applications of the present invention will become apparent from the following description in which reference is made to the embodiments illustrated in the drawings.

Throughout the description, the claims and the drawings, those terms and associated reference signs are used as are listed in the List of Reference Signs which follows below. In the drawings:

FIG. 1*a* is a perspective view of a rotor 10 according to the invention with two rotational units 22;

FIG. 1*b* is a sectional view of the rotor 10 of FIG. 1*a;*

Figure 4:
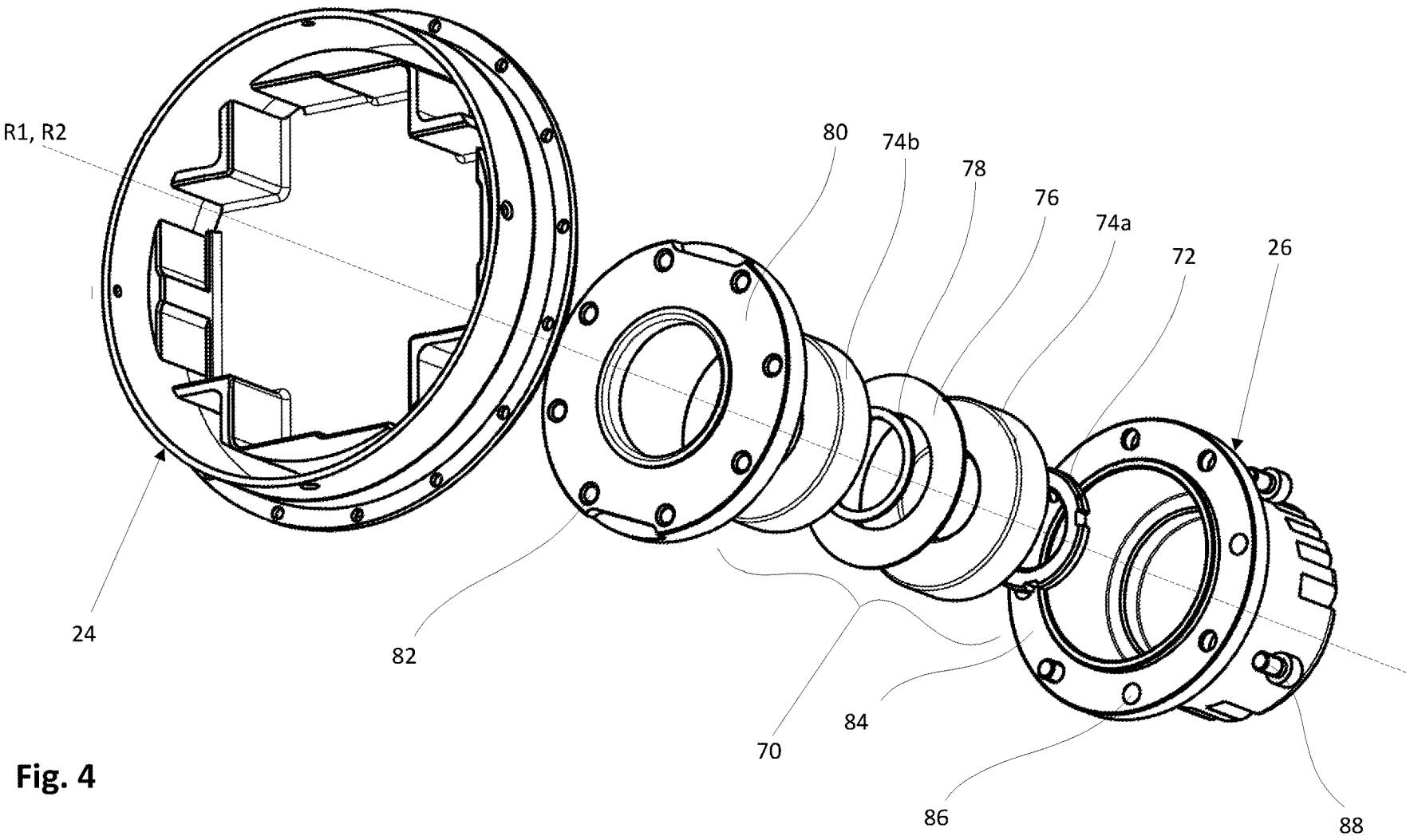
FIG. 4 is an exploded view of a rotational unit 22 of the invention.
Figure 5A:
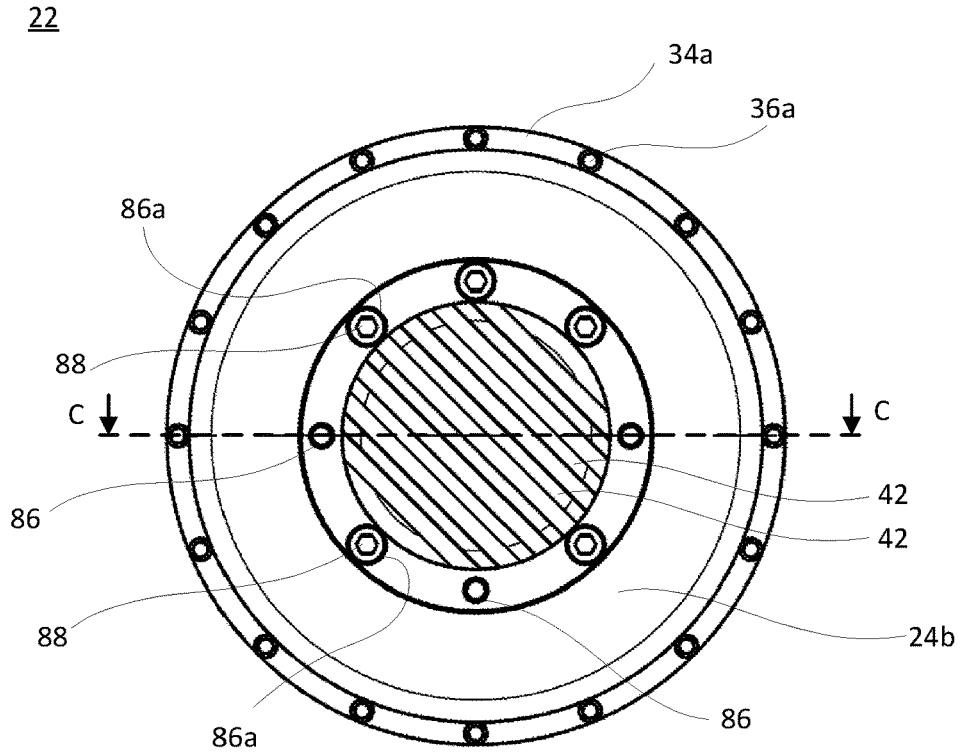

FIG. 5*a* is a view of the rotational unit 22 of in FIG. 4; and

Figure 5B:
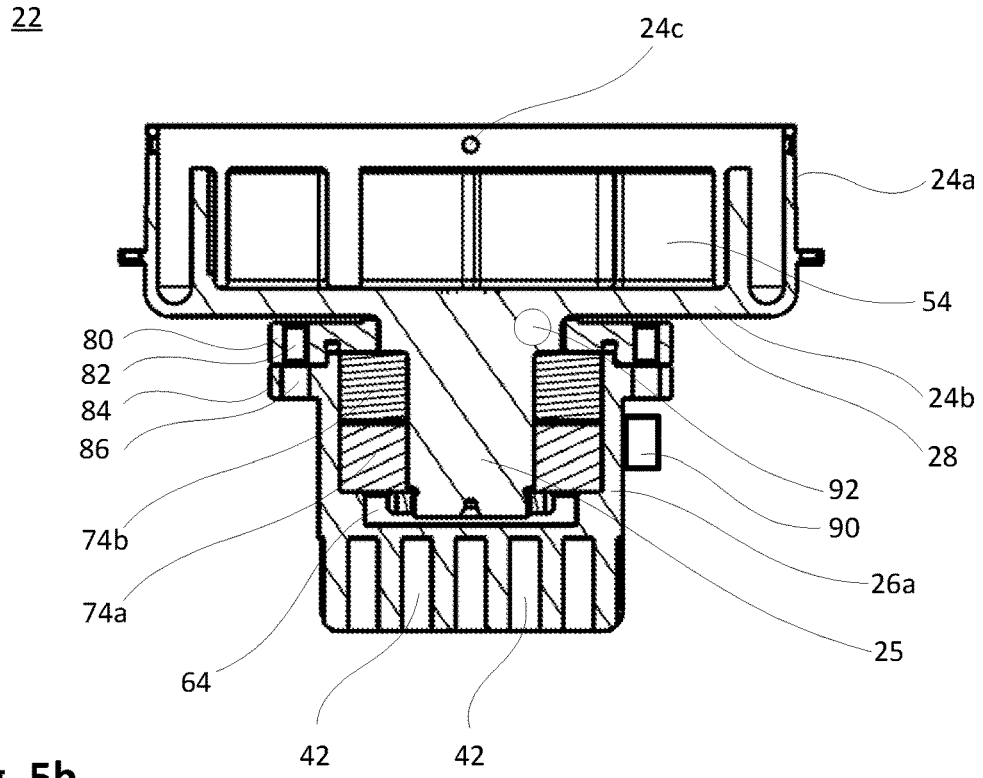

FIG. 5*b* is a view of a lateral section of the rotational unit 22 shown in FIG. 4 and FIG. 5*a* taken along the cutting line and in the cutting direction C-C depicted in FIG. 5*a*.

Figure 1A:
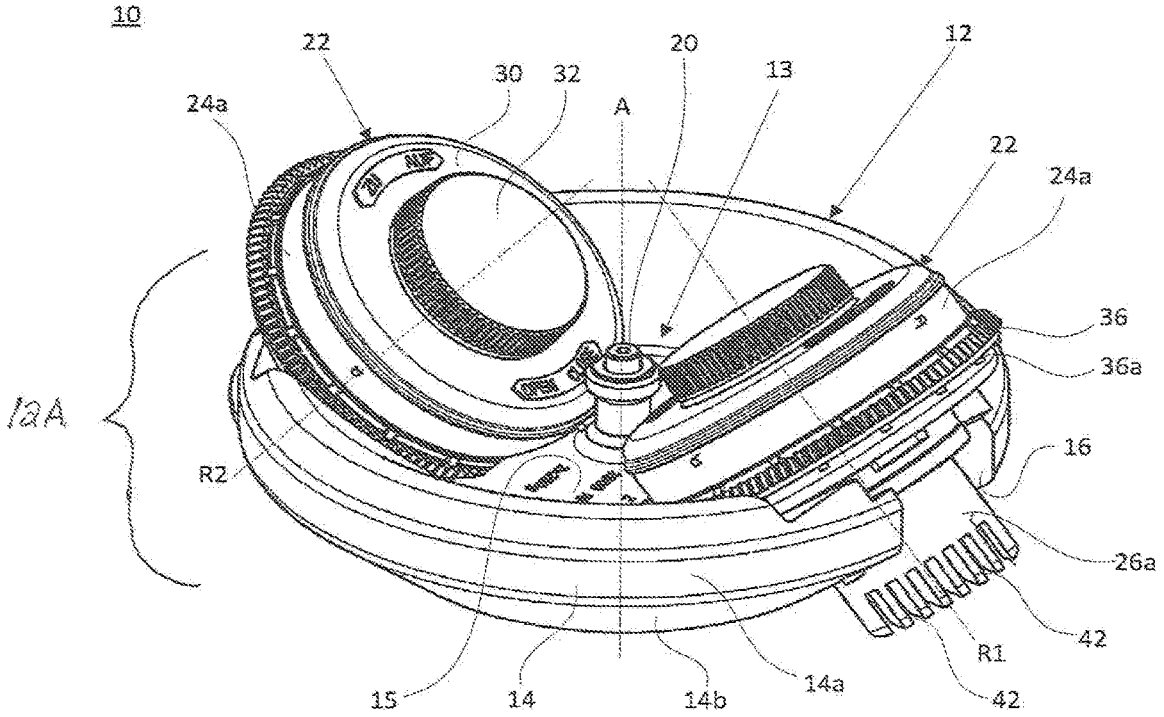
Figure 1B:
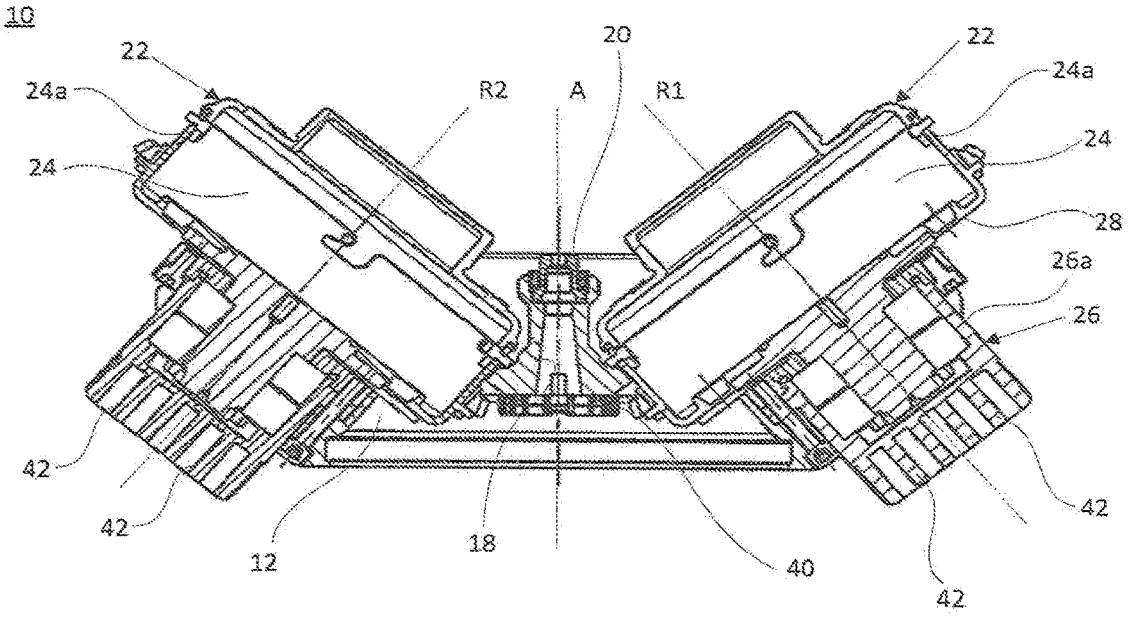

FIG. 1*a* is a perspective view of a rotor 10 according to the invention with two rotational units 22 for use in a dual centrifuge not shown in the figures. FIG. 1*b* is a sectional view of the rotor 10 illustrated in FIG. 1*a*.

The rotor 10 has a rotor head 12 of a rotationally symmetrical basic shape, which defines an envelope. The rotor head 12 is provided with a bottom 15 and a circumferential wall 14 which surrounds the bottom 15 and extends upwardly. A drive axis A runs perpendicularly through the center 13 of the rotor head 12. A drive shaft not shown in the figures extends with its free end through a recess 18 which is provided in the bottom 15 and concentric with the drive axis A. Above the recess 18, a receiving tube 20 is disposed which is integrally formed with the bottom 15 and which serves to center and vertically secure the rotor head 12 on the drive shaft.

The wall 14 has a vertical portion 14*a* and an oblique portion 14*b* which inclines downward toward the drive shaft. Two recesses 16 are provided which are located opposite each other relative to the drive axis A and which partially extend through the vertical portion 14*a* of the wall 14 and the oblique portion 14*b* of the wall 14. The rotational units 22 are accommodated in the respective recesses 16.

The rotational units 22 each have an axis of rotation R1, R2 and are aligned by the recesses 16 in such a way that the rotational axes R1 and R2 intersect the drive axis A at an acute angle above the rotor 10. Furthermore, the free ends of the rotational units 22 facing away from the drive axis A, i.e. the housings 26 described below, protrude from the envelope in the area of the oblique portion 14*b* of the wall 14.

Each rotational unit 22 has a largely rotationally symmetrical outer contour, and comprises a rotatably mounted rotational head 24 (see FIG. 2) for supporting an adapter 50 for material to be centrifuged (see FIG. 3), and a housing 26 (see FIG. 4) in which a bearing 70 for the rotational head 24 is provided, which is in turn engaged by the rotational head 24 with a bearing shaft 25 that is provided on its side facing the housing 26. Part of the bearing shaft 25 is visible in FIG. 2 and in FIG. 5*b*.

The rotational head 24 has an outer wall 24*a* which is concentric to the axis of rotation R1, R2. The housing 26 is provided with a wall 26*a* which is concentric to the axis of rotation R1, R2. The diameter of the rotational head 24 is larger than that of the housing 26 so that a shoulder 28 is formed between the outer wall 24*a* and the wall 26*a* with which the rotational unit 22 partially engages its associated recess 16, see FIG. 1*a*.

The dimensions of the housing 26 are adapted to the respective associated portions of the recesses 16. To ensure the non-rotatable connection of the housing 26 and the rotor head 12, a groove is formed in the housing 26 parallel to the axis of rotation R1, R2 and a projection is provided on the rotor head 12, which projection is associated with the groove. For the sake of clarity, the groove and the projection are not shown in the figures. Moreover, the arrangement of the groove and the projection may also be reversed. Furthermore, it is also conceivable to choose a polygonal design instead of the cylindrical design of the housing 26 so as to ensure that the housing is mounted in the rotor head in a non-rotatable manner.

According to FIG. 1*a*, the rotational head 24 is furthermore closed on the side remote from the housing 26 by a closure cap 30 which is concentrically arranged relative to the axis of rotation R1, R2. A closure knob 32 is likewise concentrically arranged on the closure cap 30, which knob 32 serves as a handle to unlock the closure cap 30 by a rotary movement and remove it, and/or to put the closure cap 30 on and lock it in place by a rotary movement against the unlocking direction.

Figure 2:
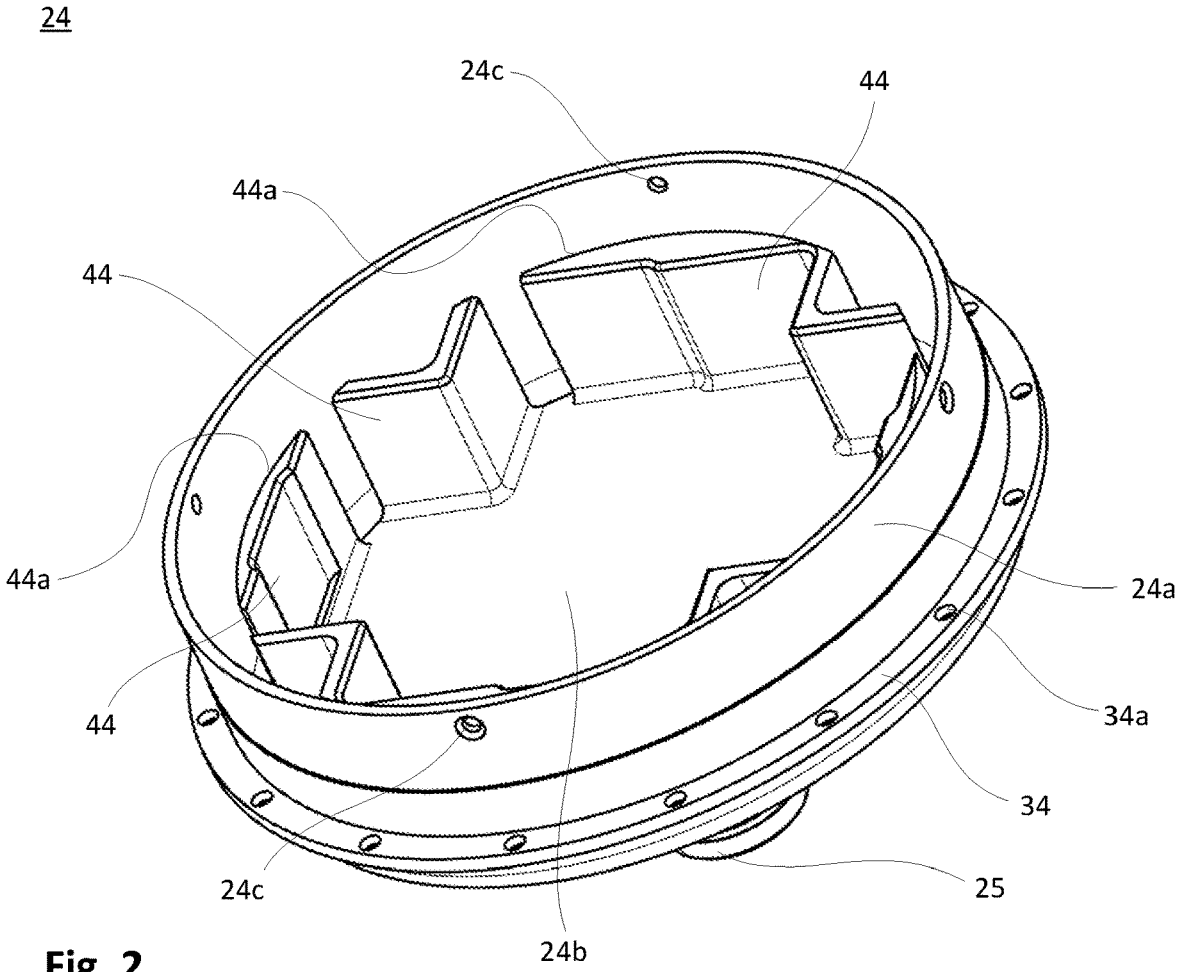
FIG. 2 is a perspective view of an inventive embodiment of a rotational head 24 without the gearing 36.

A circumferential projection 34 is provided on the upper wall 24*a* adjacent to the shoulder 28, see FIG. 2 for example, which projection 34 securely mounts a gearing 36, which is non-rotatably connected to the wall 24*a*, in a concentric alignment relative to the axis of rotation R1, R2. For transmitting the rotary movement of the rotational heads 24 about the axes of rotation R1, R2 of the rotational units 22, a gear is provided below the rotor head 12 for each rotational head 24, which gear is not shown in the figures for the sake of clarity. This gear 24 is in engagement with the gearing 36 on the one hand and with a central gear 40 which is non-rotatably connected to a motor housing not shown in the figures opposite the rotatable rotor head 12, for example by a screw connection. Such a transmission of rotary movements is well known and described in the prior art, so that no further explanations are required here.

The ratio of the main rotation (rotation of the rotor 10) to the reverse rotation (rotation of the rotational head 24) is given by the transmission ratio between the gear wheel (not shown) and the central gear 40. With the rotor head 12 removed, the gear (not shown) and the central gear 40 can be easily replaced. Therefore the speed ratio can be changed easily, by adapting the diameters of the gear (not shown) and the central gear 40.

The side of the housing 26 which is remote from the rotational head 24 has cooling ribs 42. The cooling ribs 42 are aligned perpendicular to the direction of rotation of the rotor head 12.

FIG. 2 is a perspective view of an inventive embodiment of a rotational head 24 without the gearing 36. Evenly spaced recesses 34*a* are arranged along the entire periphery of the projection 34 through which screws 36*a* extend which are provided on the underside of the gearing 36, as seen in FIG. 1*a*, and which engage in associated threaded bores in the gearing 36. The screws 36*a* extending through the recesses 34*a* securely mount the gearing 36 on the wall 24*a* and in the rotational head 24 and in particular ensure that the gearing is non-rotatably mounted relative to the rotational head 24.

Figure 3:
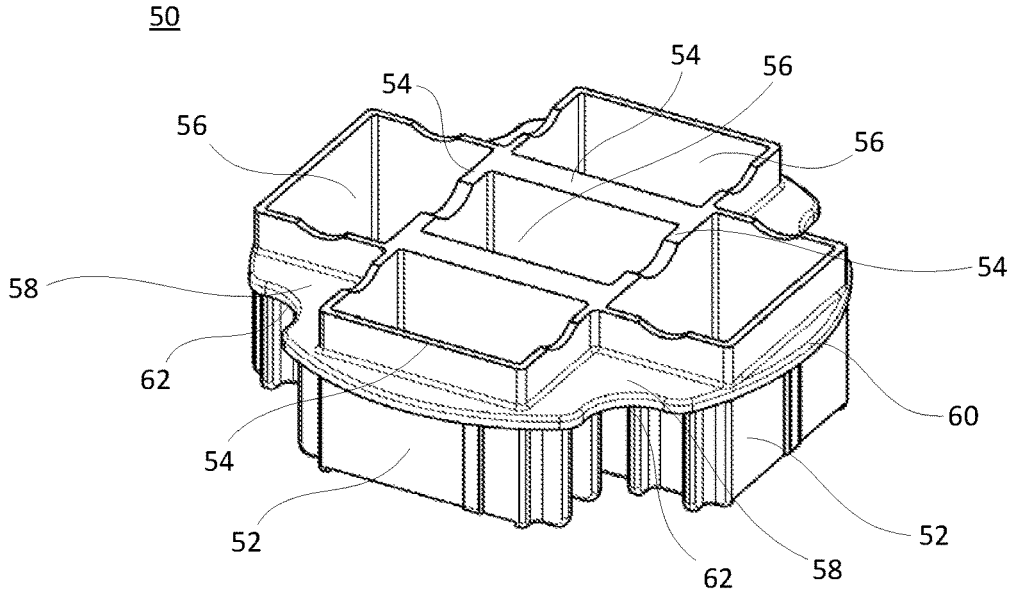
FIG. 3 is a perspective view of an adapter 50 according to the invention.

Within the wall 24*b*, walls 44 are mounted on a base plate 24*b*, which walls 44 are adapted to securely mount an adapter 50 shown in FIG. 3 for material to be centrifuged. The walls 44 define an inner profile which is matched to the outer profile of the adapter 50 of FIG. 3, which adapter 50 has a cross-shaped base area of two superposed rectangles which are concentrically rotated orthogonally to each other. The walls 44 are partially connected to each other for improved stability. Four walls 44, of which two each are disposed opposite each other as a pair, each have an outer profile 44*a* formed thereon which is rounded in such a manner that it is concentric with the wall 24*a*. The wall 24*a* has four equally spaced bores 24*c* adjacent its upper edge, which bores 24*c* are adapted to lock the closure cap 30 that has corresponding projections.

FIG. 3 is a perspective view of the aforementioned adapter 50 for material to be centrifuged. On the periphery of the aforementioned cross-shaped base area, the adapter 50 has vertically disposed integral outer walls 52. Within the outer walls 52, five rectangular recesses 56 are provided which are delimited from each other by partition walls 54, with the vertical extension of the recesses 56 corresponding to the vertical extension of the wall 24*a* of the rotational head 24. The recesses 56 are used to receive the sample container receptacles not shown in the figures and are adapted to the shape of the sample container receptacles.

Adjacent to the free upper edges of the outer walls 52 of the adapter 50, a bearing surface 58 is disposed perpendicularly on the outer walls 52, which surface 58, in the inserted state of the adapter 50, will rest on the free upper edges of the walls 44. The bearing surface 58 has an outer contour 60 which is substantially concentric with the wall 24*a* of the rotational head 24 and which has four bulges 62 which are equally spaced from one another over the periphery. The bulges 62 facilitate handling of the adapter 50 during insertion into and removal from the rotational head 24.

FIG. 4 is an exploded view of the rotational unit 22 comprising the rotational head 24 and the housing 26 with a bearing unit 70 integrated in the housing 26, with a drive shaft not shown for reasons of clarity extending concentrically through said bearing unit 70.

Starting from the housing 26, disposed along the axis of rotation R1, R2 are a clamping nut 72 for biasing the bearing unit 70, two single-row angular contact ball bearings 74*a* and 74*b*, an outer washer 76 located between the angular ball bearings 74*a* and 74*b*, as well as an inner washer 78 and a cover disk 80. All of the above elements of the bearing unit 70 have concentric bores, through which the bearing shaft 25 of the rotational head 24 extends in a play-free manner.

On the cover disk 80, eight recesses 82 are provided at equal intervals and adjacent to the outer periphery. On the side associated with the rotational head 24, the housing 26 has a flange 84 which in turn has eight recesses 86 arranged at regular intervals that are associated with the recesses 82.

FIG. 5*a* is a bottom view of the rotational unit 22. A cylinder screw 88 each engages the recesses 82 of the cover disk 80 and extends through the associated recesses 86 of the flange 84. Five recesses 82*a* each and five recesses 86*a* associated with the recesses 82*a* are provided. The cylinder screws 88 provide a screw connection of the housing 26 and the cover disk 80 in such a way that they, together with the bearing shaft 25 of FIG. 2, delimit a bearing space (64) which is encapsulated toward the outside in a lubricant-tight manner (see FIG. 5*b*).

It is well known how to fit angular contact ball bearings in pairs and how to bias them, so that further explanations are unnecessary here.

FIG. 5*b* is a view of a cross-section of the mounted rotational unit 22 shown in FIGS. 4 and 5*a* taken along a line C-C depicted in FIG. 5*a*. A lubricant refill valve having a valve line 92 is provided on the wall 26*a* between the bottom plate 24*b* and the angular contact ball bearings 74*b*. If necessary, this lubricant refill valve can be used to refill lubricant into the bearing space 64 which is encapsulated from the outside in a lubricant-tight manner. A lubricant level indicator 90 arranged on the wall 26*a* outside the housing 26 is used for inspecting the lubricant level.

LIST OF REFERENCE SIGNS

10 rotor
12 rotor head
13 center
14 wall
14*a* vertical portion
14*b* inclined portion
15 bottom
16 recesses
18 recess
20 receiving tube
22 rotational unit
24 rotational head
24*a* outer wall
24*b* base plate
24*c* bores
25 bearing shaft
26 housing

26*a* wall
28 shoulder
30 closure cap
32 closure knob
34 projection
34*a* recess
36 gearing
36*a* screws
40 central gear
42 cooling ribs
44 walls
44*a* outer profile
50 adapter
52 outer walls
54 partition walls
56 recesses
58 bearing surface
60 outer contour
62 bulges
64 bearing space
70 bearing unit
72 clamping nut
74*a, b* angular ball bearings
76 outer washer
78 inner washer
80 cover disk
82 recesses
82*a* recesses
84 flange
86 recesses
86*a* recesses
88 cylinder screws
90 lubricant level indicator
92 lubricant refill valve
A drive axis
R1, R2 axes of rotation

The invention claimed is:

1. A rotor (10) of a dual centrifuge, comprising:
a rotor head (12);
a rotational unit (22);
said rotational unit (22) comprises: a bearing unit (70); a rotational head (24) which includes a rotatable shaft (25); said rotatable shaft (25) supported by said bearing unit (70); and, a housing (26);
said bearing unit (70) is mounted in said housing (26) and supports said rotatable shaft (25);
said rotational head (24) includes a wall (24*a*);
a gear (36) is affixed to said wall (24*a*) of said rotational head (24);
a central gear (40) affixed to, and driven by, a motor;
said central gear (40) engages said gear (36) driving said rotational head (24);
said rotational head (24) of said rotational unit (22) is rotatable with respect to said housing (26) and is driven relative to said rotor head (12) and said housing (26) by said central gear (40) driving said gear (36) affixed to said wall (24*a*);
a recess (16) in said rotor head (12);
said bearing unit (70) resides in said housing (26);
said housing (26) resides in, and is removably affixed to, said recess (16) of said rotor head (12).

2. A rotor (10) of a dual centrifuge, comprising:
a rotor head (12);
a rotational unit (22);
a rotational head (24) includes a wall (24*a*);
a gear (36) is affixed to said wall (24*a*) of said rotational head (24);
a central gear (40) affixed to, and driven by, a motor;
said central gear (40) engages said gear (36) driving said rotational head (24);
said rotational unit (22) is provided in said rotor head (12);
said rotational unit (22) forms a structural unit comprised of: a housing (26), a bearing unit (70), said rotational head (24), and, said rotational head (24) includes a shaft (25);
said shaft (25) of said rotational head (24) engages said bearing unit (70);
said bearing unit (70) is mounted in said housing (26);
said bearing unit (70) enabling rotation of said rotational head (24) relative to said housing (26);
said rotational head (24) is driven relative to said rotor head (12) by said central gear (40) driving said gear (36) affixed to said wall (24*a*);
a recess (16) in said rotor head (12);
said rotational unit (22) partially resides in said recess (16) of said rotor head (12);
said housing (26) of said rotational unit (22) is fixed to said rotor head (12); and,
said housing (26) cannot rotate relative to said rotor head (12) and is detachable from said rotor head.

3. The rotor (10) according to claim 2, further comprising:
said recess (16) extends through a portion of said rotor head (12);
said rotational unit (22) is mounted therein and extends through said recess (16); and,
a lower portion of said housing (26) of said rotational unit (22) protrudes from said recess (16).

4. The rotor (10) according to claim 3, further comprising:
said rotor head includes a rotationally symmetrical shape defining an envelope (12A).

5. The rotor (10) according to claim 4, further comprising:
said housing (26) has a height and at least 30% of said height of said housing (26) protrudes beyond said envelope (12A).

6. The rotor (10) according to claim 3, further comprising:
said lower region of said housing (26) has cooling ribs (42).

7. The rotor (10) according to claim 3, further comprising:
said rotational unit (22) is securely connected to said rotor head (12) by a releasable quick fastener or a screw connection.

8. The rotor (10) according to claim 3, further comprising:
said housing (26) has sides, one of said sides includes a plurality of cooling ribs, and on another side of said housing (26) remote from said side which includes said plurality of cooling ribs (42), a flange (84) is provided which bears against said rotor head (12).

9. The rotor (10) according to claim 3, further comprising:
said recess (16) and said housing (26) are adapted to each other.

10. The rotor (10) according to claim 9, further comprising:
said housing (26) includes a cross-sectional shape and said recess (16) includes a cross-sectional shape;
said cross-sectional shape of said housing (26) and said cross-sectional shape of said recess (16) prevent rotation, said housing (26) and said recess (16) being in a polygonal shape or a cylindrical shape with projections and associated grooves.

11. The rotor (10) according to claim 3, further comprising:
a housing cover (80) with a central bore for said shaft (25) of said rotational head (24); and, said housing (26) and said housing cover (80) define a bearing space (64) for said bearing unit (70).

12. The rotor (10) according to claim 11, further comprising:

said bearing space (64) is sealed in a lubricant-tight manner.

13. The rotor (10) according to claim 12, further comprising:

said bearing space (64) is filled with lubricant; and, said lubricant is roller-bearing grease.

14. The rotor (10) according to claim 12, further comprising:

said bearing space (64) is filled with lubricant up to 50% of said height of said bearing space (64).

15. The rotor (10) according to claim 3, further comprising:

said rotational unit (22) has a wall (26*a*); and, said wall (26*a*) of said rotational unit (22) is in contact with said rotor head (12) for heat dissipation.

16. A rotational unit (22) for a rotor, comprising:

a housing (26), a bearing unit (70) and a rotational head (24) form a structural unit;

a rotor head (12) includes a recess (16) therein;

said housing (26) has sides, one of said sides includes a plurality of cooling ribs, and on another side of said housing (26) remote from said side which includes said plurality of cooling ribs (42), a flange (84) is provided which bears against said rotor head (12);

said housing of said structural unit and said structural unit is removably mounted to said rotor head (12);

a gear (36) is affixed to a wall (24*a*) of said rotational head (24);

a central gear (40) is affixed to, and driven by, a motor;

said central gear (40) engages said gear (36) driving said rotational head (24);

said rotational head (24) of said rotational unit (22) is rotatable with respect to said housing (26).

* * * * *